US005716113A

United States Patent [19]

Plourde

[11] Patent Number: 5,716,113

[45] Date of Patent: Feb. 10, 1998

[54] SLIDING SHELF FOR BEVERAGE DISPENSING MACHINE

[76] Inventor: Donald G. Plourde, 211 Chemin Titus, Paroisse Madawaska, New Brunswick, Canada, E7B 2S6

[21] Appl. No.: 730,361

[22] Filed: Oct. 15, 1996

[51] Int. Cl.[6] ..... A47F 1/04

[52] U.S. Cl. ..... 312/35; 222/160; 248/439; 248/188.6; 312/309; 312/317.3; 312/273

[58] Field of Search ..... 312/271, 273, 312/309, 317.3, 35; 222/160; 248/439, 188.6, 188.1, 188.91; D7/301, 306, 307

[56] References Cited

U.S. PATENT DOCUMENTS

| | | | |
|---|---|---|---|
| 1,897,072 | 2/1933 | Parks et al. | D7/301 X |
| 2,563,935 | 8/1951 | Huffman et al. | D6/307 X |
| 2,598,266 | 5/1952 | Kamin et al. | 312/273 X |
| 2,755,156 | 7/1956 | Nichols | 312/309 |
| 3,862,788 | 1/1975 | Hock et al. | 312/223.1 X |
| 4,928,853 | 5/1990 | Isham et al. | D7/307 X |

FOREIGN PATENT DOCUMENTS

| | | | |
|---|---|---|---|
| 1036803 | 9/1953 | France | 312/317.3 |

*Primary Examiner*—José V. Chen
*Assistant Examiner*—Stephen Vu
*Attorney, Agent, or Firm*—Mario D. Theriault

[57] ABSTRACT

A beverage vending machine having a sliding shelf for supporting thereon one or more beverage containers. Folding legs are provided under the shelf for supporting the weight of the shelf when the shelf is in an extended position. The deployment and retraction of the legs is effected by a pair of pantograph actuators, coincidently with a movement of the shelf when the shelf is within a minimal distance from the extended position.

20 Claims, 4 Drawing Sheets

SLIDING SHELF FOR BEVERAGE DISPENSING MACHINE

FIELD OF THE INVENTION

This invention relates to a sliding shelf for a beverage dispensing machine. More particularly, the present invention relates to a sliding shelf with folding legs which are actuated to and from between a retracted position and a deployed position coincidently with the respective movement from the extending and retracting of the shelf.

BACKGROUND OF THE INVENTION

A number of different types of beverage dispensing machines are connected to a supply of fresh water and have several containers of concentrated syrup of different fruit flavours. When a fruit drink is selected by a customer, by activating an appropriate push button for example, a measure of fresh water is automatically mixed with a measure of syrup to produce the selected drink. The fruit drink is then dispensed into a cup accessible to the client.

All subterranean water contains minerals and other chemical substances and compounds which are soluble in the water and affect its taste. Therefore, the taste of a fruit drink from the beverage dispenser in one location may differ from the taste of the same named drink purchased from a dispenser connected to a differently located water well. For this primary reason, beverage caterers prefer to sell pre-mixed beverages made with distilled water and having a consistent taste upon which a market response can be reliably monitored, and a good reputation can be established.

Beverage dispensing machines for selling pre-mixed beverages are relatively voluminous in size in order to house a variety of beverage containers, each having a relatively large capacity. A common size of beverage container has a volume of 5 U.S. gallons (18.9 liters), and weighs in excess of 42 pounds when full. Therefore it can be a difficult task to some persons to handle these containers into and out a beverage dispensing machine.

In this respect, a number of prior art beverage dispensers are equipped with a sliding shelf for supporting the beverage containers. For example, U.S. Pat. No. 3,949,902 issued on Apr. 13, 1976 to Frank B. Thompson describes a sliding shelf for supporting four inverted bottles. The shelf is movable from a retracted position inside the cabinet of the apparatus to an extended position where the bottles can be easily replaced. Similarly, Canadian Patent 1,121,772 issued on Apr. 13, 1982, to Boström et al. describes a milk dispenser having a sliding shelf for supporting two-20 liter milk packages.

The beverage dispensing machines of the above-described examples have a relatively low center of gravity, whereby the loading of the shelf in the extended position is not detrimental to the stability of the apparatus.

Beverage dispensing machines of the modem type, however, have a tall rectangular shape with dimensions of as much as can afford the overall clearance of a standard commercial doorway. The center of gravity of these machines is therefore relatively high as compared to the aforesaid prior art apparatus. Moreover, in some machines, the refrigeration compressor and motor is mounted in the upper region of the dispenser's cabinet. This has the effect of raising the center of gravity of the machine even further upward.

For these reasons, the sliding cantilever shelves of the prior art, although convenient to manipulate heavy beverage containers, would become a safety concern if installed on modem dispensers having a high center of gravity. An unintentional overloading of the shelf in the extended position could cause a tall machine to tip forward and fall toward the person tending it.

SUMMARY OF THE INVENTION

In the present invention, however, there is provided a beverage vending machine having a sliding shelf with folding legs for supporting the weight of the shelf when the shelf is in an extended position.

In one aspect of the present invention, there is provided a beverage vending machine for distributing water, milk, fruit flavoured drinks or the like to clients, comprising of a tall rectangular upright cabinet with a closable opening on a front side thereof. This cabinet contains a plurality of beverage containers, beverage dispensing equipment connected to the beverage containers and control means connected to the equipment for controlling the operation of the machine.

The beverage vending machine further has a first shelf mounted inside a lower portion of the cabinet for supporting one or more beverage containers. This shelf is movably guided by a pair of extendable track means mounted inside the cabinet. The first shelf is movably guided along a horizontal plane through the opening of the cabinet, from a retracted position with an entire surface thereof being enclosed within the cabinet to an extended position with a major portion thereof projecting outside the cabinet.

The first shelf has folding legs mounted under a front portion thereof. The legs are movable from a folded position under the first shelf to a deployed position extending to a floor surface near a base of the cabinet for supporting the weight of the first shelf when the first shelf is in the extended position.

A first advantage of the sliding shelf of the present invention is that beverage containers are replaced safely even when the center of gravity of the beverage vending machine is relatively high. The first shelf is positively braced against any inadvertent downward forces thereon, when a beverage container needs to be pushed into a collar socket for example.

In accordance to another aspect of the present invention, each folding leg comprises a pantograph actuator for deploying the leg in a circular motion about a horizontal axis perpendicular to a direction of movement of the first shelf, wherein the circular motion is opposite the movement of the first shelf. The deployment and folding of the leg by the pantograph actuator is further effected coincidently with a movement of the first shelf when the first shelf is within a minimal distance from the extended position. Therefore, the folding leg of the beverage vending machine of the present invention does not cause excessive friction on the floor when the shelf is moved to and from the extended position.

BRIEF DESCRIPTION OF THE DRAWINGS

The preferred embodiment of the present invention will be further understood from the following description, with reference to the drawings in which.

DETAILED DESCRIPTION OF THE PREFERRED EMBODIMENT

Figures 1, 2:
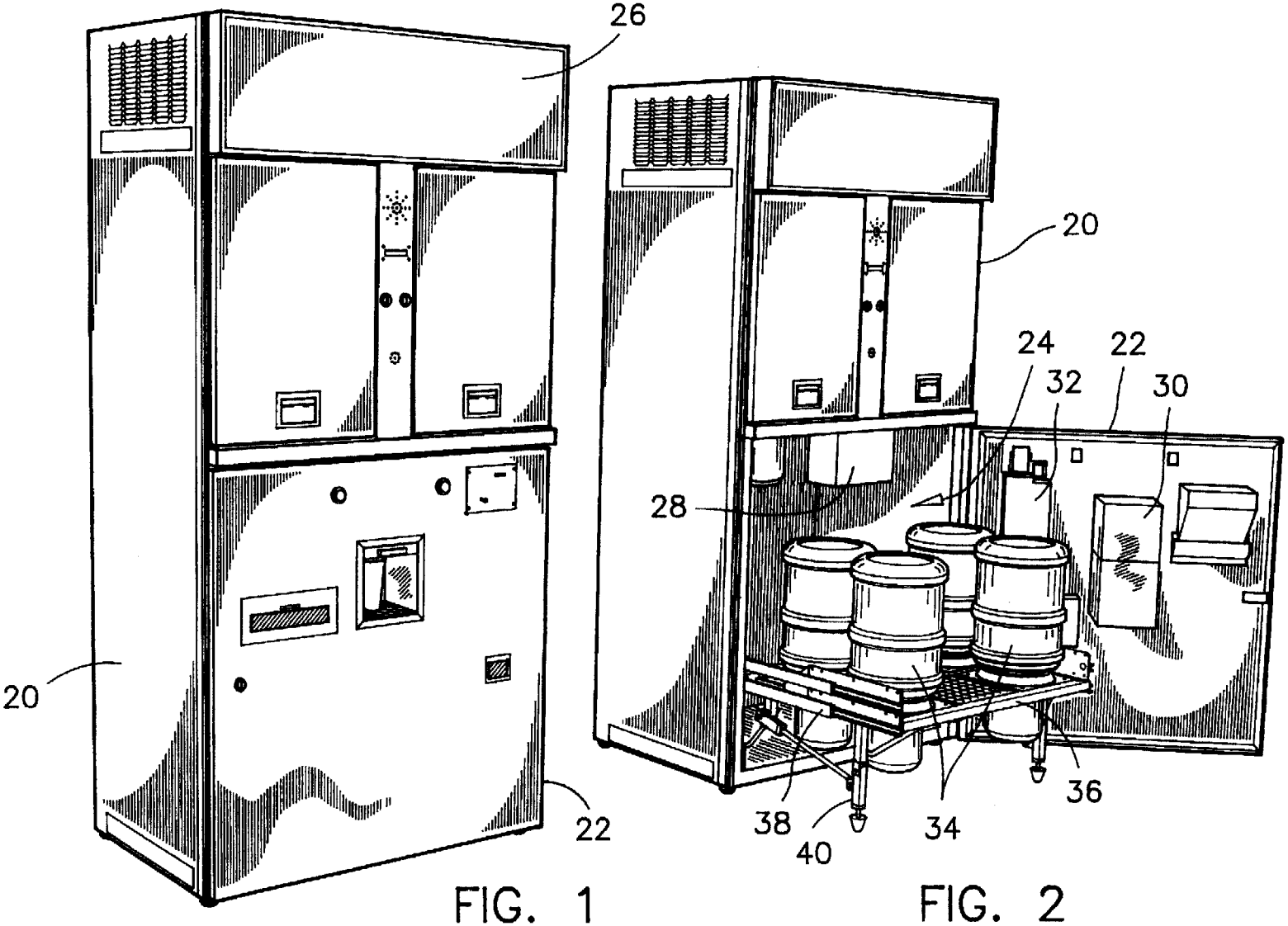
FIG. 1 is a perspective view of the beverage vending machine of the preferred embodiment.
FIG. 2 is a perspective view of the beverage vending machine of the preferred embodiment with the bottom door opened and the sliding shelf in the fully extended position.
Figure 3:
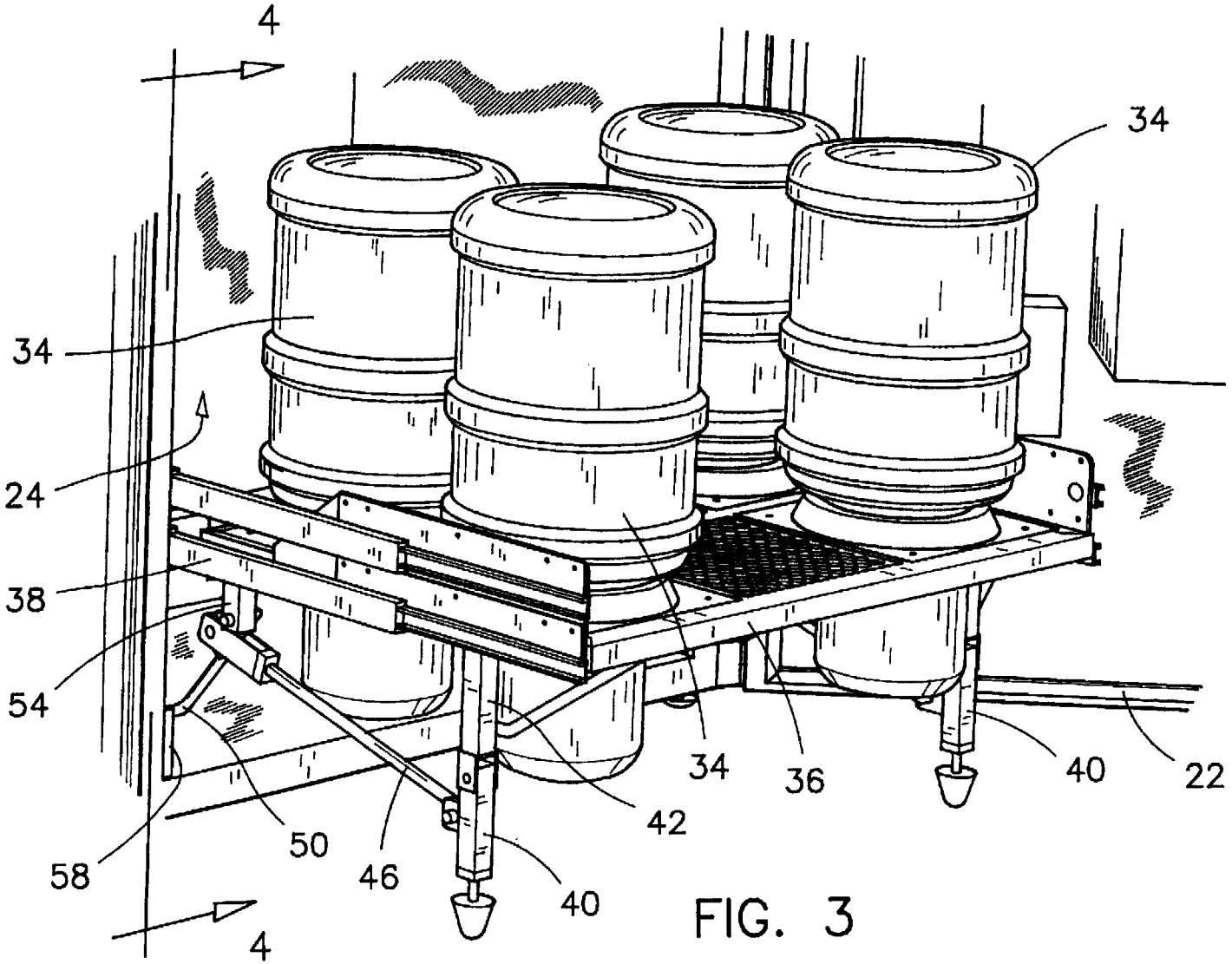
FIG. 3 is an enlarged view of the sliding shelf of the preferred embodiment.

With reference to FIGS. 1, 2 and 3, the beverage vending machine 20 of the preferred embodiment has one or more doors 22 giving access to an inside compartment 24. An upper portion 26 of the vending machine 20 preferably contains the refrigeration unit, such that the inside compartment 24 remains free for accommodating cup dispensing equipment 28, drink dispensing equipment 30, coin handling equipment 32, and for storing a number of containers 34 of milk, water, and pre-mixed beverages.

The lower portion of the inside compartment 24 comprises a sliding shelf 36 which is movable on tracks 38 form a retracted position inside the compartment 24 to an extended position as illustrated in FIG. 2. The sliding shelf 36 has a pair of legs 40 articulated in a folded position under the shelf and in a deployed position as shown in FIGS. 2 and 3.

The legs 40 have sufficient reach for supporting the weight of the shelf in the extended position, and for preventing a condition of instability of the vending machine 20 when heavy loads such as jugs 34 full of beverage are placed on the shelf 36.

Referring now to FIGS. 4 to 8, the folding legs 40 are pivoted on a pair of first bracket members 42 about an axis 44 which is horizontal and perpendicular to the direction of movement of the shelf 36. Each leg 40 is articulated about axis 44 by a pantograph actuator.

Each pantograph actuator has a link member 46 connected at a first end thereof to a respective folding leg 40 by means of a first pivot joint 48. A second end of each link member 46 is connected to an intermediate position on a lever 50 by means of a second pivot joint 52. A first extremity of the lever 50 is pivotally connected to a second bracket member 54 under the sliding shelf 36 by means of a third pivot joint 56.

Each pantograph actuator further comprises of a cam plate 58 mounted inside the compartment 24, below the guide rail 60 supporting the track 38, on the same side of the enclosure 24 as the pantograph actuator. The cam plate 58 has a horizontal groove 62 extending along a substantial greater portion thereof. The horizontal groove 62 connects with a U-shaped groove 64 in the foremost portion of the cam plate 58. The second extremity of each lever 50 is enclosed into the groove 62,64 and is adapted for movement there along.

Figure 5:
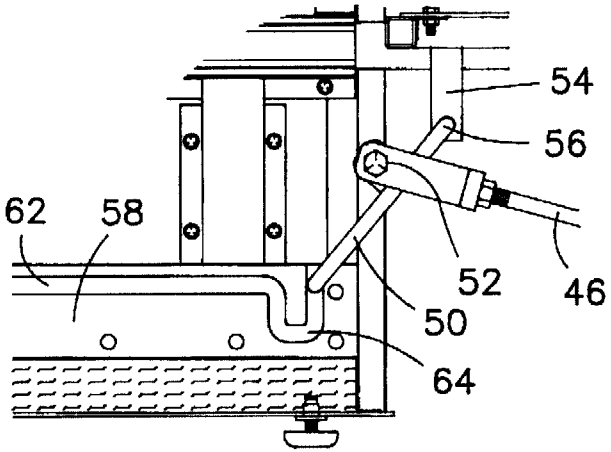
FIG. 5 is an enlarged view of Detail 5 in FIG. 4.
Figure 4:
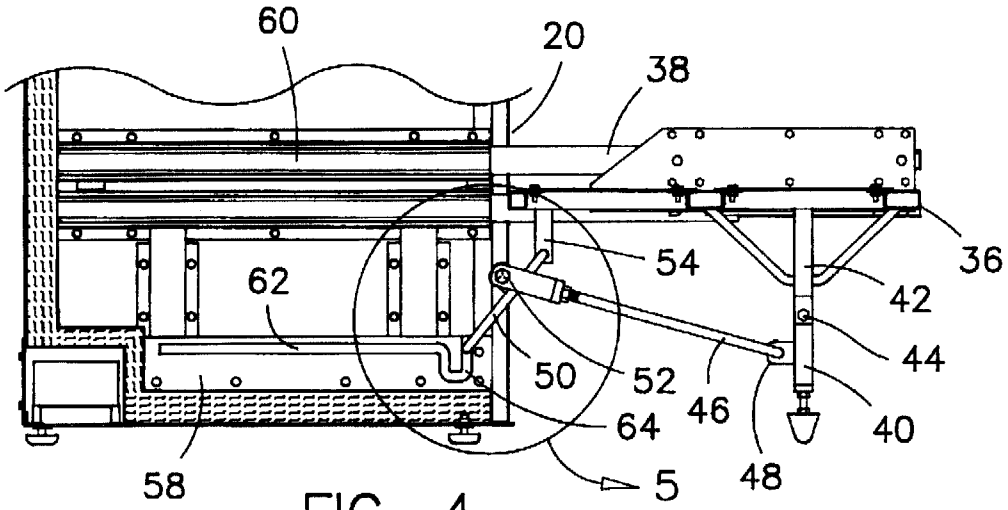
FIG. 4 is a cross-section view of the beverage vending machine along line 4—4 in FIG. 3.

When the sliding shelf 36 is in an extended position, as illustrated in FIGS. 4 and 5, the second end of the lever 50 is held captive inside the foremost arm of the U-shaped groove 64. The folding legs 40 are thereby held in a vertical position as illustrated in FIG. 4, for supporting the shelf 36.

Figure 7:
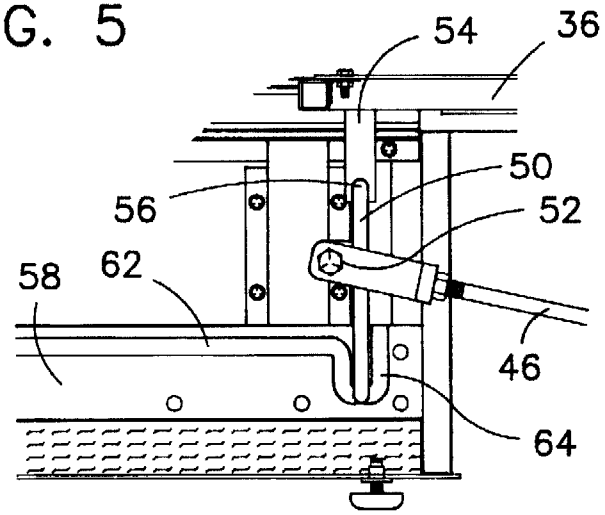
FIG. 7 enlarged view of Detail 7 in FIG. 6.
Figure 6:
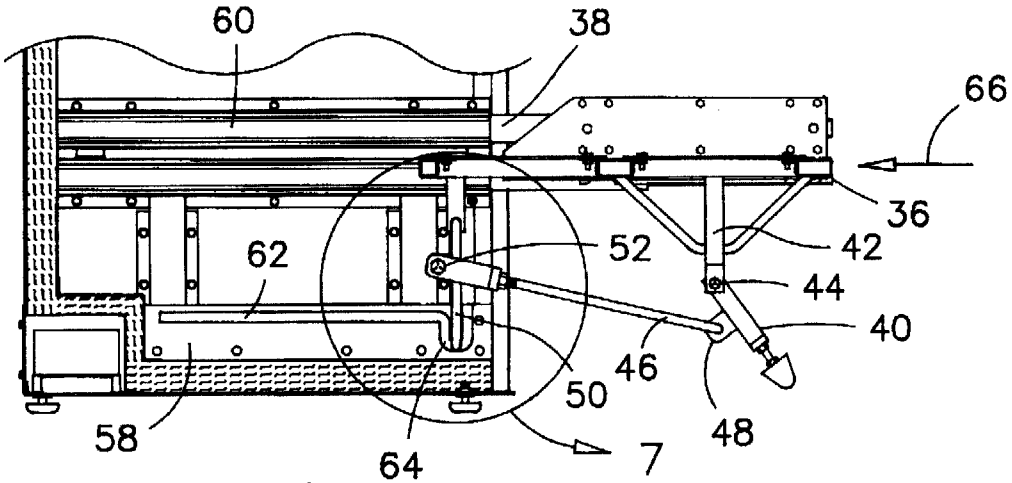
FIG. 6 is also a cross-section view of the beverage vending machine showing the sliding shelf in an intermediate position between a fully extended position and a retracted position.

Referring now particularly to FIGS. 6 and 7, there is illustrated therein a best mode of operation of the folding legs 40 of the sliding shelf 36 of the preferred embodiment. Upon a movement of the sliding shelf 36 in a retracting direction as indicated by arrow 66, the second or lower end of lever 50 is forced into the bottom portion of the U-shaped groove 64. This causes the link member 46 to push against the folding legs 40 to pivot the legs 40 about axis 44 and toward a retracted position.

Figure 8:
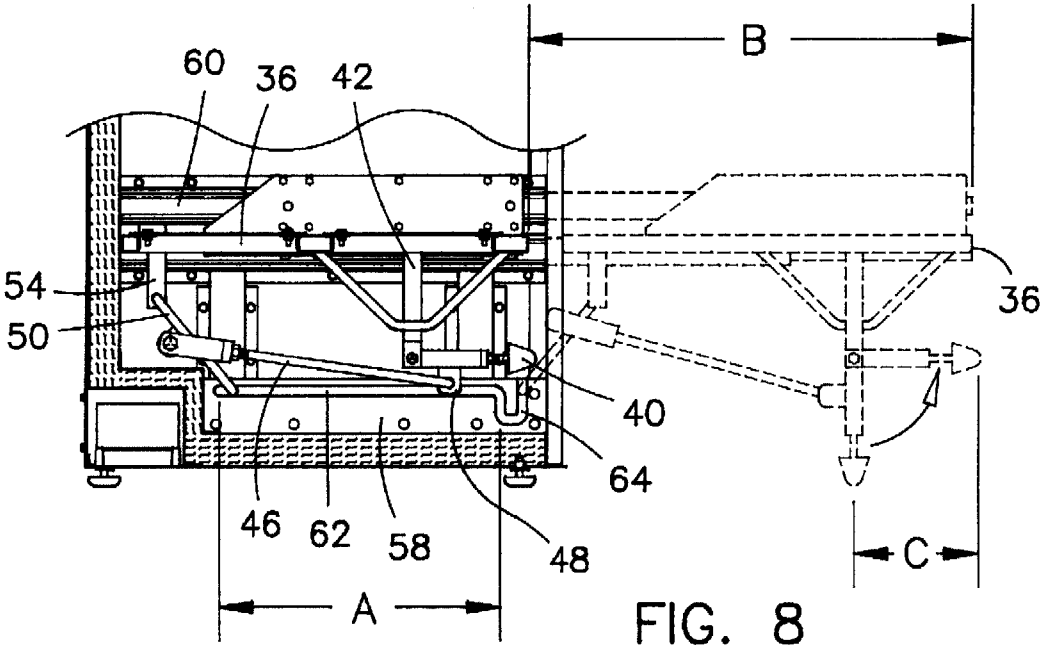
FIG. 8 is further a cross-section view of the beverage vending machine showing the sliding shelf in the fully retracted position, with dashed lines showing the fully extended position.

The retractive movement of the shelf 36 causes each lever 50 to rotate about pivot joint 56 until the lower end thereof reaches a point where it can slide into the horizontal groove 62. At this point, the leg 40 is in a fully retracted position parallel to the shelf 36, as illustrated in FIG. 8.

The length and position of the above-described bracket members 42,54, link members 46, levers 50 and cam plates 58 are determined such that the legs are actuated in a supporting position as quickly as possible when the sliding shelf 36 reaches a fully extended position.

In this regard, a preferred length of a horizontal groove 62 as shown as label 'A' is of about sixteen inches when the sliding shelf 36 extends over a distance 'B' of about twenty-four inches. Concurrently, a preferred reach 'C' of the legs 40 is about six inches.

This arrangement of the pantograph actuator and the above preferred dimensions is particularly efficient in that the relative horizontal displacement of the lower end of the legs 40 and a point on the floor in front of the dispenser is only about two inches, when the shelf moves through the foremost eight inches of its travel. The described arrangement ensures that the folding legs 40 are deployed and retracted with minimum dragging on the floor.

The supporting of the shelf is effected only when the shelf is nearing a fully extended position. This is further particularly advantageous wherein the supporting of the shelf is only needed when full jugs 34 are placed on it. The attendant servicing this machine can support the foremost edge of the shelf 36 when pushing the shelf back inside the compartment 24, thereby avoiding any security problem at that time.

Figure 9:
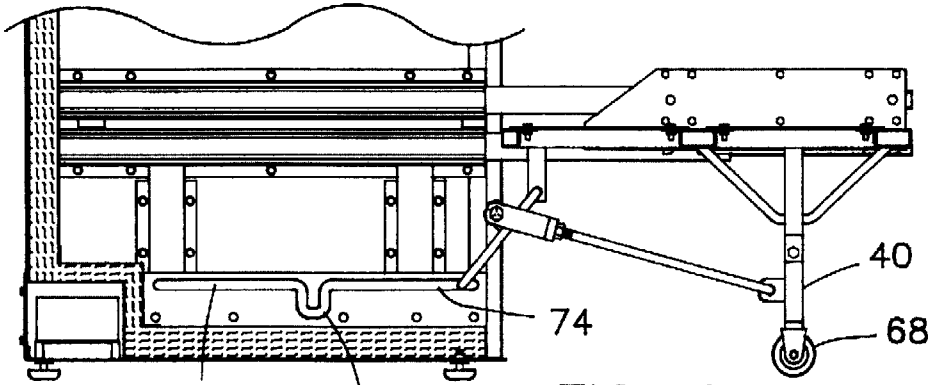
FIG. 9 is another cross-section view of the beverage vending machine showing an alternate embodiment of a folding leg having a caster on a lower end thereof.

An alternate embodiment of the folding legs 40 of the present invention is illustrated in FIG. 9. Each folding leg 40 has a caster 68 mounted on a lower end thereof. In this alternate embodiment, each leg 40 is preferably deployed when the sliding shelf is near a mid-point of its travel. Consequently, a U-shaped groove 70 is preferably positioned between two horizontal segments 72 and 74, of substantially equal length. In this alternate embodiment, the folding legs 40 support the sliding shelf 36 over a longer distance than with the previously described preferred embodiment. In this respect, it will become apparent to the persons skilled in this an that the respective length of horizontal segments 72 and 74 can be varied to accommodate a deployment of legs 40 at a location to suit a particular installation.

Figure 10:
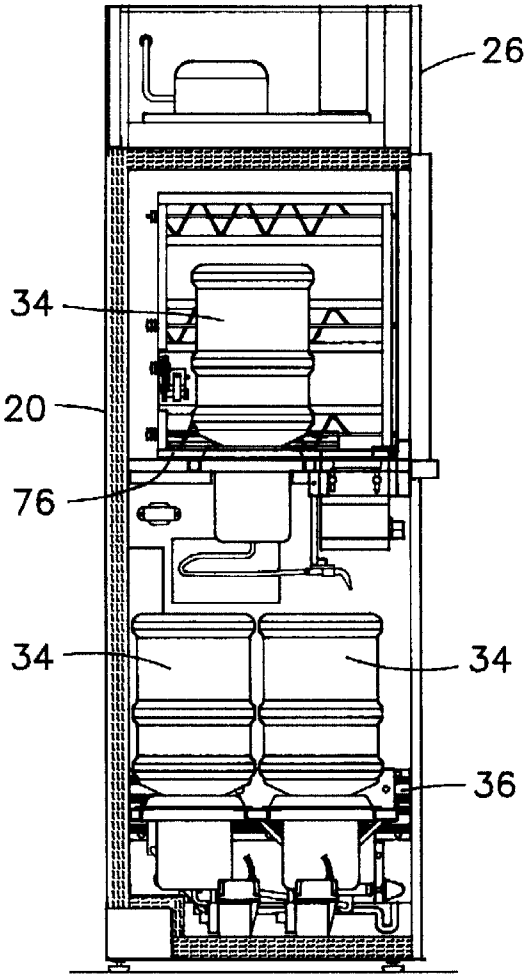
FIG. 10 is a cross-section through the entire height of the beverage vending machine of the preferred embodiment.

Referring now to FIG. 10, the beverage vending machine 20 of the preferred embodiment having the sliding shelf 36 of the present invention can easily accommodate up to six jugs 34; four of which are placed on the sliding shelf 36 and the other two are supported on a top shelf 76. Each of these jugs 34 can be replaced safely without imparting frontward tilting forces to the machine.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, constructions features or the like. Therefore, the above description and the illustrations should not be construed as limiting the scope of the invention which is defined by the appended claims.

I claim:

1. A beverage vending machine for distributing water, milk, fruit flavoured drinks or the like to clients, comprising:

a tall rectangular upright cabinet having a front side and an opening in said front side; said cabinet containing a plurality of beverage containers, beverage dispensing equipment connected to said beverage containers and control means connected to said equipment for controlling an operation thereof;

a first shelf mounted inside a lower portion of said cabinet for supporting one or more of said beverage containers, said first shelf being movably guided by a pair of extendable track means mounted inside said cabinet, said first shelf being movably guided along a horizontal plane through said opening, from a retracted position with an entire surface thereof being enclosed within said cabinet to an extended position with a major portion thereof projecting outside said cabinet;

said first shelf further comprising folding leg means mounted under a front portion thereof, said folding leg means being movable from a folded position under said first shelf to a deployed position extending to a floor surface near a base of said cabinet for supporting a weight of said first shelf when said first shelf is in said extended position; and actuator means for deploying said folding leg means conincidently with a movement of said first shelf when said first shelf is within about one third a span between said retracted position and said extended position.

2. A beverage vending machine as claimed in claim 1 wherein said actuator means is a pantograph actuator connected to said first shelf, said folding leg means and said cabinet.

3. A beverage vending machine as claimed in claim 1 wherein a deployment of said folding legs is a circular motion about a horizontal axis perpendicular to a direction of said movement of said first shelf.

4. A beverage vending machine as claimed in claim 3 wherein said circular motion is opposite said direction of said movement of said first shelf.

5. A beverage vending machine as claimed in claim 4 wherein a relative movement between a lower end of said folding leg means and a point on said floor surface is about one twelfth a span between said retracted position and said extended position.

6. A beverage vending machine as claimed in claim 5 wherein said folding legs means comprises casters mounted on a lower end thereof.

7. A beverage vending machine as claimed in claim 6 wherein said major portion of said shelf is said entire surface thereof.

8. A beverage vending machine as claimed in claim 1 wherein said one or more of said containers is four jugs having each a volume of 5 U.S. gallons.

9. A beverage vending machine as claimed in claim 8 further comprising a second shelf above said first shelf and said plurality of beverage containers comprises at least two 5 U.S. gallon jugs on said second shelf.

10. A beverage vending machine as claimed in claim 9 further comprising refrigeration equipment mounted in an upper portion of said cabinet above said second shelf.

11. A beverage vending machine for distributing water, milk, fruit flavoured drinks or the like to clients, comprising:

a tall rectangular upright cabinet having a front side and an opening in said front side, said cabinet containing a plurality of beverage containers, beverage dispensing equipment connected to said beverage containers, and control means connected to said equipment for controlling an operation thereof;

a first shelf mounted inside a lower portion of said cabinet for supporting one or more of said beverage containers, said first shelf being movably guided by a pair of extendable track means mounted inside said cabinet, said first shelf being movably guided along a horizontal plane through said opening, from a retracted position with an entire surface thereof being enclosed within said cabinet to an extended position with said entire surface thereof projecting outside said cabinet;

a pair of folding legs mounted under a front portion of said first shelf for supporting a weight of said first shelf when said first shelf is in said extended position, said pair of folding legs being articulated about a horizontal axis perpendicular to a direction of movement of said first shelf;

each of said folding legs being connected to a pantograph actuator having a link member, a lever and a cam plate having a continuous groove therein and being rigidly mounted inside said cabinet; said lever having a first end thereof pivotally connected to said first shelf and a second end thereof being movably enclosed in said groove, said link member being pivotally connected at a first extremity thereof to an intermediate point between said first and second ends of said lever and at a second extremity thereof, to one of said pair of folding legs at a nominal distance from said horizontal axis;

whereby upon movement of said first shelf, a displacement of said second end of said lever along said groove relative to said first shelf is translated into a corresponding displacement of said folding leg, for articulating said leg between an uppermost horizontal position and a deployed vertical position.

12. A beverage vending machine as claimed in claim 11 wherein said groove comprises a horizontal segment joining a U-shaped segment near said opening.

13. A beverage vending machine as claimed in claim 12 wherein when said folding legs are in said deployed position, said second end of said lever is held captive in said U-shaped segment.

14. A beverage vending machine as claimed in claim 12, wherein said first shelf is movable over a distance of about twenty-four inches and a length of said horizontal segment is about sixteen inches.

15. A beverage vending machine as claimed in claim 14 wherein a reach of said legs is about six inches, whereby a relative movement between a lower tip of said leg and a point on said floor surface during a deployment of said leg is about two inches.

16. A beverage vending machine as claimed in claim 11 wherein a deployment of said folding legs is a circular motion about said horizontal axis, and said circular motion is opposite said direction of movement of said first shelf.

17. A beverage vending machine as claimed in claim 11 wherein said movement of said first shelf is about one third of a span between said extended position and said retracted position.

18. A beverage vending machine as claimed in claim 11 wherein said groove comprises first and second horizontal collinear segments an a U-shaped segment joining said first segment to said second segment.

19. A beverage vending machine as claimed in claim 18 wherein said movement of said first shelf is near a mid-region between said extended position and said retracted position.

20. A beverage vending machine as claimed in claim 19 wherein said folding legs have casters mounted on a lower end thereof.

* * * * *